US005317823A

United States Patent [19]

Brunt, II

[11] Patent Number: 5,317,823

[45] Date of Patent: Jun. 7, 1994

[54] THREE-DIMENSIONAL POP-UP DISPLAY AND METHOD FOR MAKING THE SAME

[76] Inventor: William F. Brunt, II, 631 2nd Ave. S., Nashville, Tenn. 37212

[21] Appl. No.: 871,508

[22] Filed: Apr. 21, 1992

[51] Int. Cl.[5] ..... G09F 1/08

[52] U.S. Cl. ..... 40/124.1; 40/539

[58] Field of Search ..... 40/124.1, 539, 160; 446/148, 487

[56] References Cited

U.S. PATENT DOCUMENTS

| | | | |
|---|---|---|---|
| 895,771 | 8/1908 | Lackner | 446/148 |
| 930,108 | 8/1909 | Walcutt | 446/148 |
| 1,467,624 | 9/1923 | Nash | 40/124.1 X |
| 1,557,332 | 10/1925 | Robbins | 40/124.1 X |
| 1,853,615 | 4/1932 | Howard | 40/539 |
| 2,102,553 | 12/1937 | Cohen | 446/148 |
| 2,511,211 | 6/1950 | Klein et al. . | |
| 2,742,723 | 4/1956 | Klein et al. | 446/148 |
| 3,995,388 | 12/1974 | Penick et al. . | |
| 4,349,973 | 9/1982 | Penick et al. | 40/124.1 |
| 4,763,427 | 8/1988 | Schrager | 40/539 X |

FOREIGN PATENT DOCUMENTS

| | | |
|---|---|---|
| 1080005 | 4/1960 | Fed. Rep. of Germany . |
| 770219 | 9/1934 | France . |
| 379486 | 9/1932 | United Kingdom . |

*Primary Examiner*—Kenneth J. Dorner
*Assistant Examiner*—J. Bonifanti
*Attorney, Agent, or Firm*—Bacon & Thomas

[57] ABSTRACT

A three-dimensional pop-up display which may be made from a single generally rectangular piece of cardboard or the like and a method for forming the same are disclosed. The display includes three portions and an internal hinged support member for maintaining the display in an open position. The display may also include a pocket formed as a part of the display.

8 Claims, 3 Drawing Sheets

THREE-DIMENSIONAL POP-UP DISPLAY AND METHOD FOR MAKING THE SAME

This invention relates to a three-dimensional pop-up display and, more particularly, to a three-dimensional pop-up display which is made from a single rectangular sheet of cardboard or the like and to a method for making the same.

BACKGROUND OF THE INVENTION

Manufacturers of books, boxes, cards and other novelty items have, for many years, incorporated three-dimensional pop-up scenes in such devices. In such scenes, a portion or portions of a card or the like are constructed and arranged to extend in different vertical and horizontal planes when erected. Such scenes are normally collapsible to provide a relatively flat package with the various portions of the scenes in a superimposed relationship.

In some cases, the cards or other items incorporating such scenes have been produced from a single generally rectangular sheet of paper board and at times incorporate a locking device for maintaining the card or the like in an open or erect position. The importance of manufacturing such items from a single sheet has also been recognized. It is this factor in many cases that makes the structure commercially practical, permitting the card to be produced and sold at a competitive price.

Examples of such displays are disclosed in the following United States patents: Penick et al., U.S. Pat. No. 3,995,388; Klein et al., U.S. Pat. No. 2,742,723; Freedman et al., U.S. Pat. No. 2,544,783; and Cohn, U.S. Pat. No. 2,102,553, each of which is incorporated herein in its entirety by reference.

It has now been found that an improved three-dimensional pop-up display in accordance with the present invention is particularly applicable for use as a "super sports card," wherein a participant or number of participants can be displayed in a number of positions. Such displays can be manufactured from a single sheet of relatively inexpensive paper board in a manner which is believed to be more economical than those disclosed by the prior art. In addition, the displays can be manufactured in a manner which maximizes the utilization of a single sheet, i.e., minimize the portion of cardboard which is discarded as waste.

In addition, the three-dimensional pop-up displays disclosed herein are of relatively sturdy construction and include an internal hinged support for maintaining the display in an erect or open position. The displays also include a separate fold-out portion which may be used to display a set of sports trading cards or the like. A further embodiment of the invention may also be used for temporarily inserting a product, such as a compact disc, into the display.

BRIEF SUMMARY OF THE INVENTION

In essence, the present invention contemplates a three-dimensional pop-up display which is constructed from a single generally rectangular flat sheet of paperboard or cardboard having a printable front and a back surface. The flat sheet also includes two transverse fold lines thereon for dividing the sheet into three portions, i.e., an inner and two outer portions. The inner or central portion also includes a perpendicular fold line which is perpendicular to the transverse fold lines and which divides the inner portion into upper and lower segments. The inner portion is constructed and arranged to be folded along the perpendicular fold line so that the upper and lower segments will be superposed.

A first one of the outer portions includes a longitudinal cut which is parallel to the perpendicular fold line and which is preferably an extension thereof for dividing the first one of the outer portions into two separate segments. A first of the separate segments is adjacent to the upper segment of the central portion and is folded forwardly along the first transverse fold line over and into engagement with and adhesively fixed onto the upper segment with the second separate segment also folded forwardly into engagement with the front or facing surface of the lower segment of the central portion and adhesively fixed thereto. In an alterative form, the first of the separate segment is folded rearwardly but not adhesively fixed.

A second one of the outer portions includes a plurality of lateral fold lines which are generally perpendicular to the transverse fold lines and a plurality of cuts to thereby define shapes for a desired scene or effect. The second outer portion is folded over or along the second of the transverse fold lines into engagement with the back surface of the first separate segment and a back surface of the lower segment of the central portion and selected areas on the front surface of the second outer portion are adhesively fixed to the back surface of the first separate segment and back surface of the lower segment to thereby form a relatively flat package. This flat package is then folded over along the perpendicular fold line with the second outer portion forming the interior of a final folded package. When the inner portion is folded into an open position to form an internal angle of about 45° to about 135° and preferably 90°, the second of the outer portions will provide a plurality of extensions in various horizontal and vertical planes which are self-erecting into a pop-up scene when the interior sections are moved from a superimposed to an open position.

The invention will now be described in connection with the accompanying drawings.

DETAILED DESCRIPTION OF THE PREFERRED EMBODIMENT OF THE INVENTION

Figure 1:
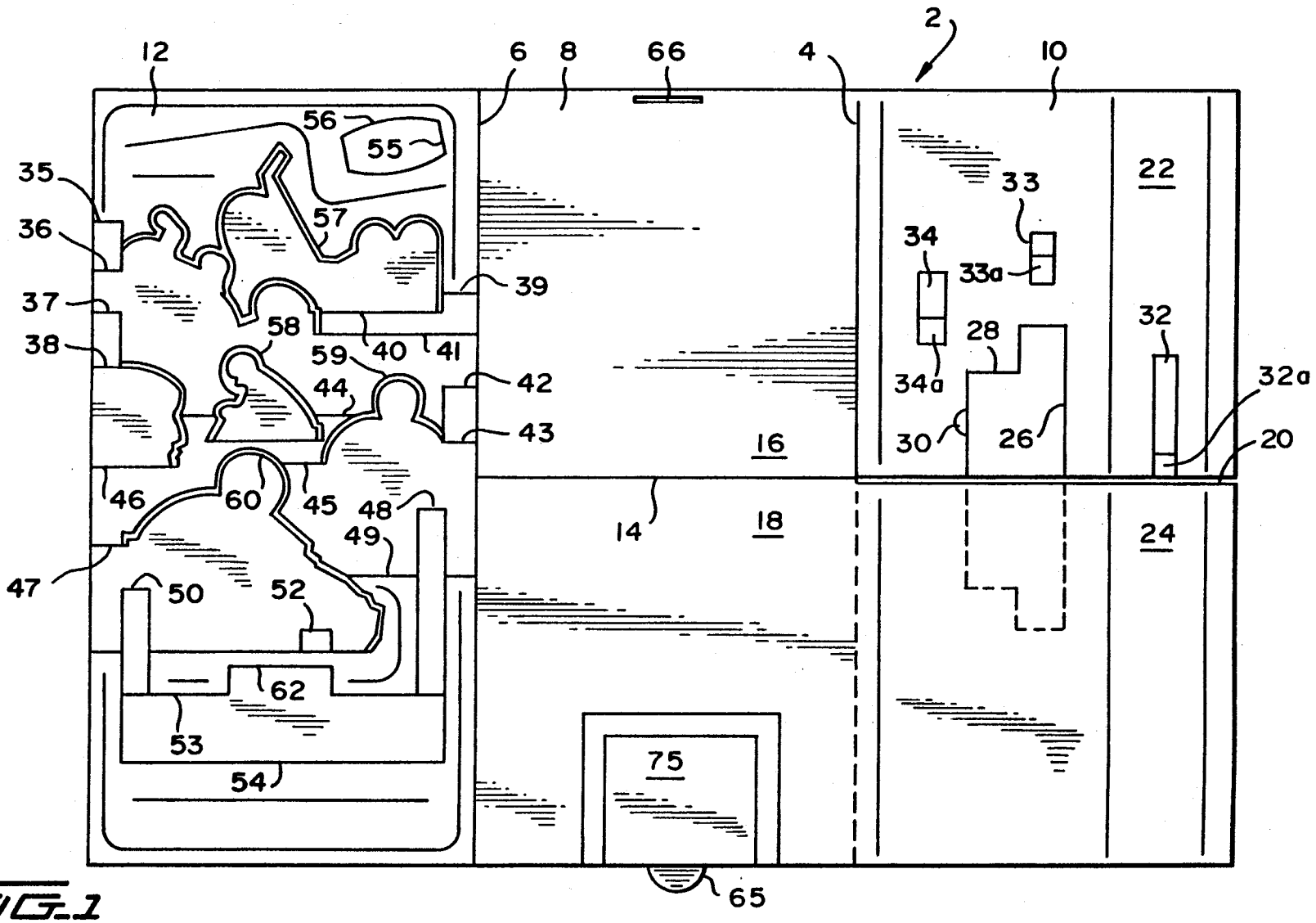
FIG. 1 is a plan view of a three-dimensional pop-up blank in accordance with a preferred embodiment of the invention.
Figures 2, 4:
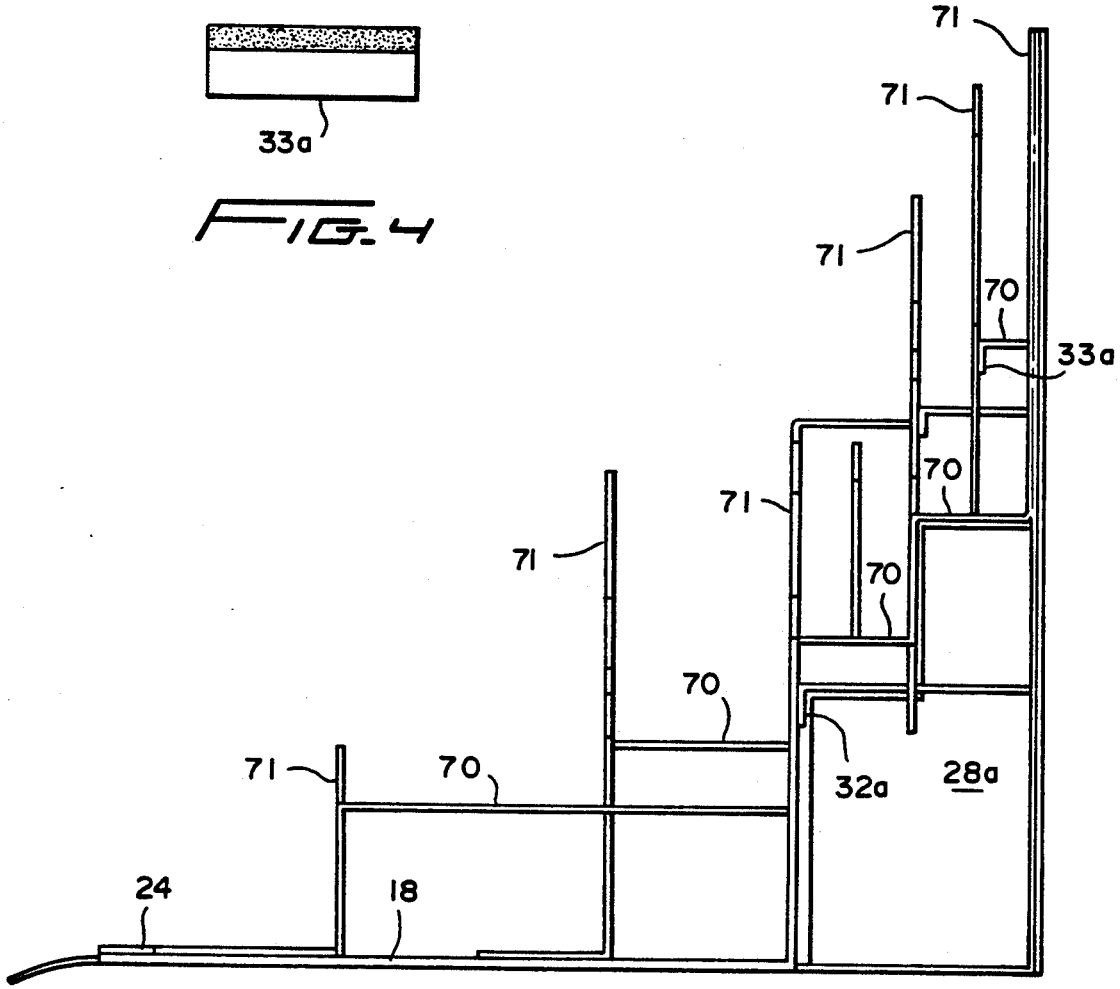
FIG. 2 is a side-elevational view of the three-dimensional pop-up shown in FIG. 1 but in an open or erect position and with one segment removed.
FIG. 3 is a perspective view of an alternative form of the three-dimensional pop-up display shown in FIG. 2 but without having a segment removed and FIG. 4 is an illustration showing an adhesive coating which is applied to portions of the display in accordance with the present invention.

As shown in FIGS. 1 and 2, a three-dimensional pop-up display is formed from a generally rectangular flat sheet 2 of paper, cardboard or similar material. The sheet 2 has a front and back surface with the back or top surface shown in FIG. 1. The sheet 2 is divided into three, approximately equal, portions by two transverse fold lines 4 and 6. The fold lines 4 and 6 divide the sheet 2 into a central or inner portion 8 and two outer portions 10 and 12. The central portion 8 also includes a perpendicular fold line 14 which is essentially perpendicular to the transverse fold lines 4 and 6 and which divides the inner portion 8 into two essentially rectangular segments, an upper segment 16 and lower segment 18 which are preferably of the same size. These segments 16 and 18 are preferably square.

A first of the outer portions 10 includes a longitudinal cut 20 along an extension of the perpendicular fold line 14. This longitudinal cut 20 removes a portion of material as, for example, a strip about 3/32" (about equal to the thickness of the board) divides outer portion 10 into two separate square segments 22 and 24 of about equal size. The width of the strip may vary depending on the size of the display, but facilitates construction of the pop-up display. The separate segments 22 and 24 are of about the same size and shape minus the area of the longitudinal cut 20 as upper segments 16 and lower segment 18 and are adapted to be folded along the transverse fold line 4 into superimposed relationship with upper segment 16 and lower segment 18. In the preferred embodiment of the invention, the separate segment 22 is lifted upwardly, i.e., forwardly and folded over and onto upper segment 16 so that the upper surface of each are in contact with or face one another and adhesively fixed together by an adhesive coating 22*a*. At the same time, the segment 24 is also folded forwardly along fold line 4 so that the upper surface of separate segment 24 comes into contact with the upper surface of the lower segment 18 and is adhesively fixed thereto.

As shown in FIG. 1, the separate segment 22 also includes a third transverse fold line 26 which may extend upwardly from the cut 20 for a distance of about 40% of the height of the separate segment 22, i.e., only to an internal portion thereof. This upward extension will vary to accommodate the design of the display. The segment 22 also includes a step shaped cut 28 which connects the innermost portion of fold line 26 and the cut 20 to thereby form a hinged support member. An arc-shaped cut 30 may also be made in separate segment 22 adjacent to a portion of cut 28. Removal of the area defined by the arc-shaped cut 30 and cut 28 facilitates the bending of the hinged support into a supporting position, i.e., at an angle of about 90° to segment 22.

The separate segment 22 may also include a plurality of rectangular supports 32, 33 and 34 which are formed by cutting along three sides thereof and by providing a pair of fold lines. The back or outer surfaces of portions 32*a*, 33*a* and 34*a* may also be covered with an adhesive for contact with selected parts of outer portion 12.

Figure 3:
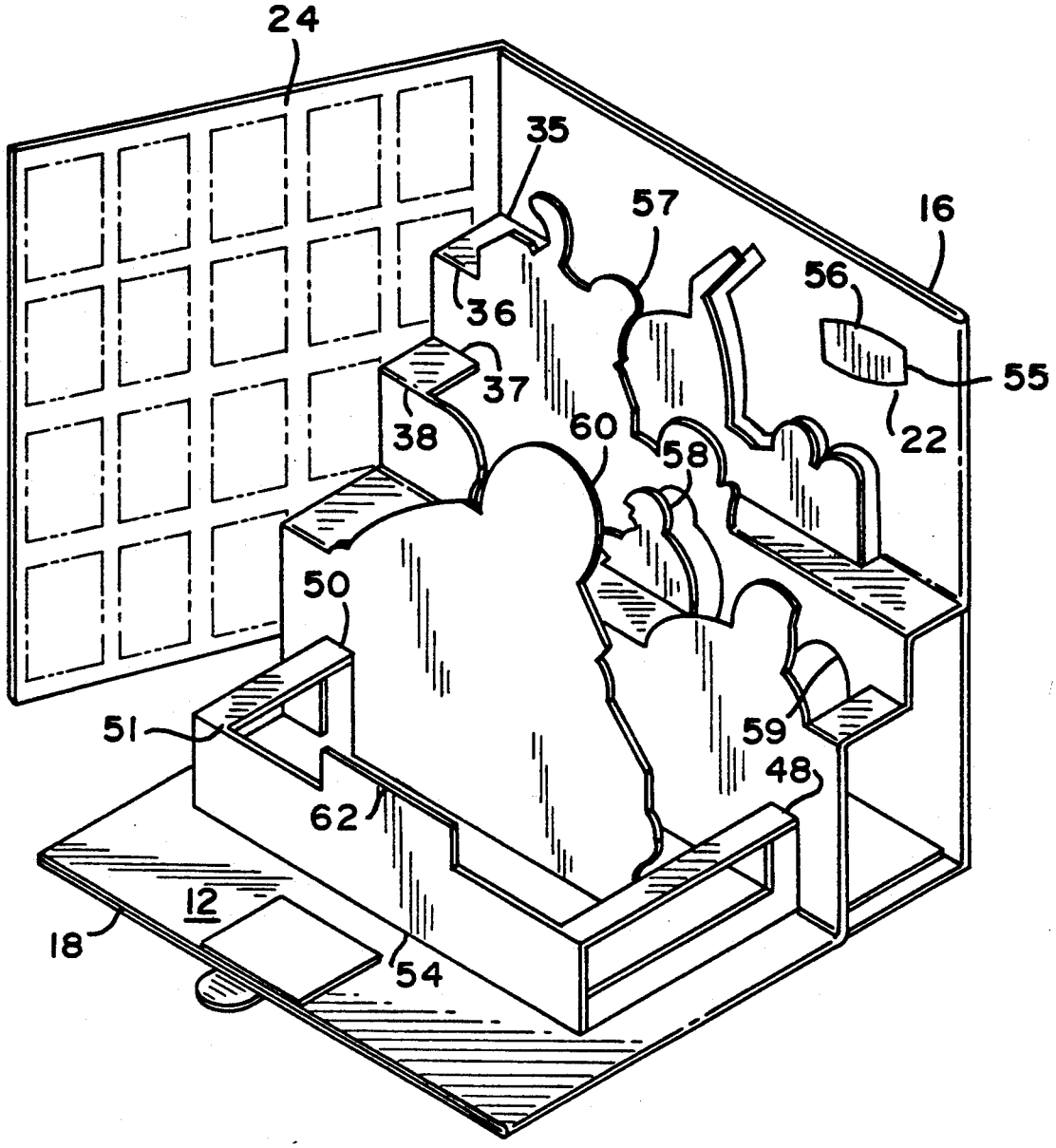

The second outer portion 12 also includes a plurality of fold lines 35–55 and a plurality of cuts 56–62 to form or define a plurality of shapes for a desired effect. These cuts, which may be referred to as "scrap around" remove about 1/16"–⅛" wide strip or portion of cardboard so that the pop-up figures do not bind during erection. The ⅛" width is preferred for a display wherein the flat sheet is trimmed to about 24" by 30" and the paper board is 22 pound SBS board. For example, the cuts may be in the shape of an athlete in the various positions he or she assumes during a typical sports event. For example, one shape might be in the form of a short-stop fielding a ball while another might be the same player in a throwing position. As illustrated in FIGS. 1 and 3, a fold line 55 and cut 56 in portion 12 may be used to depict an object such as a hockey puck, baseball or the like which is folded outwardly along fold line 55 to add to the three-dimensional perspective.

The first or upper separate segment 22 is constructed and arranged to be folded along the transverse fold line 4 so that the upper surface 10 is folded over onto and into engagement with and adhesively fixed to an upper segment 16. The second or lower segment 24 is also constructed and arranged to be folded along the transverse fold line 4 in the same manner.

The second outer portion 12 is also constructed and arranged or adapted to be folded along the transverse fold line 6 so that the front surface of portion 12 is folded over onto and into engagement with the back surface of separate segments 22 and 24 and adhesively bonded to portions 32*a*, 33*a* and 34*a* as well as along the top approximately 2 inches of outer portion 12 and along the bottom approximately 2 inches of outer portion 12 by an adhesive coating such as 22*a* and at various other points of portion 12 to thereby form a flat package. This flat package is then folded over along the perpendicular fold line 14 to thereby form a square, flat package of six layers. A tab 65 and slot 66 are provided for holding the package in a closed or flat position with the tab 65 extending outwardly from segment 18 and the slot 66 cut in the far side of segment 16 as shown in FIG. 1.

As shown in FIGS. 2 and 3, the pop-up structure includes a plurality of horizontal planes 70 and vertical planes 71 which are cut and bent from portion 12 and which planes are integrally joined to each other at the fold line which marks their line of intersection. Thus, the pop-up section, when decorated and colored to show an athlete or a plurality of athletes in various positions, produces a three-dimensional picture which pops-up or is self-erecting when the package is opened.

Also as shown more clearly in FIG. 2, the step-shaped hinged support 28*a* from separate segment 22 is folded outwardly at 90° and engages two of the horizontal planes 70 and two of the vertical planes 71 to thereby support or hold the display in an open position with the portions 16 and 18 forming an internal angle of 90°. The hinged support 28*a* is shown as not quite engaging the horizontal and vertical planes 70, 71 for purposes of illustration. It should also be recognized that the number of horizontal or vertical planes and their engagement with hinged support 28*a* will vary in accordance with the design of a display.

It should also be recognized that the internal support may be formed in the lower separate segment 24 as shown by the dotted lines in FIG. 1 in which case it would be folded upwardly therefrom at an angle of 90° to maintain the structure in its open position.

It is also within the scope of the present invention to incorporate the pop-up display in a book or the like.

As illustrated in FIG. 3, the separate segment 24 is constructed and arranged to form a part of the display. This segment 24 may, for example, include a plurality of sports trading cards and may, in some cases, be removed from the display. For example, if a plurality of trading cards are printed on separate segment 24, the segment may be removed and cut to provide a plurality of separate trading cards.

In a further embodiment of the invention, a pocket 75 is formed by scoring/crimping and by gluing lower segment 18 and segment 24 in a manner to form a pocket which is adapted to receive a flat object such as a compact disc or the like inserted therein. Such pocket may, for example, be about 5¼" in width and height to accommodate a standard compact disc.

While the invention has been described in connection with one of its preferred embodiments, it should be understood that changes and modifications may be made without departing from the scope of the appended claims.

What is claimed is:

1. A three-dimensional pop-up display comprising a generally rectangular flat sheet of cardboard having a printable front surface and a back surface and two transverse fold lines thereon for dividing said sheet into an inner and two outer portions which are of essentially equal size, said inner portion including a perpendicular fold line which is essentially perpendicular to said transverse fold lines and which divides said inner portion into two essentially square segments of essentially the same size which are adapted to be folded over upon one another along said perpendicular fold line, a first of said outer portions including a longitudinal cut along an extension of said perpendicular fold line to thereby divide said first outer portion into two separate square segments of about equal size, a first of said separate segments including a third transverse fold line which is essentially parallel to said two transverse fold lines and which extends from said longitudinal cut to an inner portion of said first of said separate segments and a transverse cut connecting said longitudinal cut with said third transverse fold line at an inner portion thereof to thereby define a support member which can be folded outwardly along said third transverse fold line at an angle of about 90°, a second of said outer portions including a plurality of lateral fold lines which are generally perpendicular to said transverse fold lines and a plurality of cuts to thereby define shapes for a desired effect, a first of said separate segments adapted to be folded over along a first of said transverse fold lines and adhesively fixed onto one of said segments of said inner portion and the second of said separate segments adapted to be folded over along said first transverse fold lines and adhesively fixed to the front of the second segment of said inner portion, said second outer portion adapted to be folded over along the second of said transverse fold lines into engagement with the back surface of said first separate segment and a back surface of a second segment of said inner portion with portions thereof adhesively fixed thereto to thereby form a relatively flat pack which may be folded over along said perpendicular fold line of said inner portion into a relatively flat closed position so that when said inner portion is folded along said perpendicular fold line to an angle of about 90° the second of said outer portions will provide a plurality of extensions in various horizontal and vertical planes which are self erecting into a pop-up scene when the interior sections are moved from a superimposed to an open position.

2. A three-dimensional pop-up display in accordance with claim 1 in which said first separate segment is adapted to be folded rearwardly into an open position to form a part of the display.

3. A three-dimensional pop-up display in accordance with claim 1 in which said transverse fold line between said inner portion and said second separate segment include a number of perforations so that the second separate segment can be readily separated from the display.

4. A three-dimensional pop-up display in accordance with claim 1 in which said support member defines a step-like structure with a plurality of horizontal support members and a vertically-disposed shoulder and in which said support member is adapted to be folded outwardly at an angle of about 90° to form the plane of said inner portion.

5. A three-dimensional pop-up display in accordance with claim 4 in which the plurality of horizontal support members and said vertically-disposed shoulder engage said plurality of extensions in said horizontal and vertical planes.

6. A three-dimensional pop-up display in accordance with claim 5 in which a first of said segments of said inner portion defines a slot near its side which is farthest from the perpendicular fold line and in which a tab is provided on one side of said second segment of said inner portion so that said tab can be inserted into said slot when the display is in a folded position to hold the display in that position.

7. A three-dimensional pop-up display in accordance with claim 6 which includes a pocket for receiving a relatively flat object.

8. A method for making a three-dimensional pop-up display comprising the steps of:

providing a generally rectangular flat sheet of carboard having a front and back surface;

forming two transverse fold lines thereon for dividing the sheet into an inner and two outer portions which are of essentially equal size;

forming a perpendicular fold line in the inner portion essentially perpendicular to the transverse fold lines to thereby divide the inner portion into two rectangular segments;

making a longitudinal cut in a first of the outer portions along an extension of the perpendicular fold line to remove a portion thereof and to thereby divide the first outer portion into two separate rectangular segments;

forming a third transverse fold line in a first of the separate segments which is essentially parallel to the two transverse fold lines and which extends from the longitudinal cut to an inner portion of the first of the separate segments and making a step-shaped cut connecting said longitudinal cut with the third transverse fold line at an inner portion thereof to thereby define a step-shaped hinged member which can be folded outwardly along the third transverse fold line at an angle of about 90°;

defining a plurality of shapes for a desired effect by forming a plurality of lateral fold lines and cuts in the second of the outer portions with the fold lines generally perpendicular to the transverse fold lines;

folding a first of the separate segments over and along a first of the transverse fold lines and onto one of the segments of the inner portion;

folding the second of the separate segments along the first transverse fold line against the second segment of the inner portion;

folding the second outer portion over along the second of the transverse fold lines into engagement with the second segment of the inner portion to thereby form a relatively flat pack; and folding the relatively flat pack over along the perpendicular fold line of the inner portion into a relatively flat closed position so that when the inner portion is folded along the perpendicular fold line to an open position at an angle of about 90°, the second of the outer portions will provide a plurality of extensions in various horizontal and vertical planes which are self-erecting into a pop-up scene when the interior sections are moved from the closed to the open position.

* * * * *